US006390889B1

(12) United States Patent
McGregor et al.

(10) Patent No.: US 6,390,889 B1
(45) Date of Patent: May 21, 2002

(54) HOLDING STRIP FOR A SEMICONDUCTOR INGOT

(75) Inventors: A. Dempsey McGregor, Mesa, AZ (US); Marshall P. Toombs, Fredericksburg, VA (US); James E. Brooks, Fredericksburg, VA (US); Benjamin J. Meadows, Fredericksburg, VA (US)

(73) Assignee: Virginia Semiconductor, Fredericksburg, VA (US)

( * ) Notice: Subject to any disclaimer, the term of this patent is extended or adjusted under 35 U.S.C. 154(b) by 0 days.

(21) Appl. No.: 09/408,138

(22) Filed: Sep. 29, 1999

(51) Int. Cl.[7] ..... B24B 1/00

(52) U.S. Cl. ..... 451/41; 451/390; 451/408; 125/13.01; 125/13.02; 125/21; 125/35; 125/901

(58) Field of Search ..... 125/13.01, 13.02, 125/21, 35, DIG. 901; 451/41, 390, 403, 406, 408, 412

(56) References Cited

U.S. PATENT DOCUMENTS 4,227,348 A * 10/1980 Demers ..... 125/13.01
4,819,387 A * 4/1989 Harbarger ..... 125/13.01
4,949,700 A * 8/1990 Ebashi ..... 125/13.01
5,123,636 A * 6/1992 Dumler et al. ..... 269/15
5,316,586 A * 5/1994 Hoenk et al. ..... 268/286
5,799,644 A * 9/1998 Nishida ..... 125/35
5,875,769 A * 3/1999 Toyama et al. ..... 125/16.01
6,006,736 A * 12/1999 Suzuki et al. ..... 125/13.02
6,106,365 A * 8/2000 Gessler ..... 451/8

* cited by examiner

*Primary Examiner*—M. Rachuba
(74) *Attorney, Agent, or Firm*—Fish & Richardson PC

(57) ABSTRACT

A holding strip is used to hold a semiconductor ingot during semiconductor wafer fabrication. The holding strip is formed from a semiconductor material, typically the same material used to form the ingot itself. The holding strip has a holding surface shaped to receive the ingot and at least one surface other than the holding surface, into which at least one notch is formed. The holding strip has a characteristic breaking strength that changes when a cut is formed through the holding surface and into the notch. In some embodiments, the notch has sides that are substantially parallel to each other, and in other embodiments, the notch has tapered sides. In alternative embodiments, the shape of the notch causes an abrupt change or a gradual change in the breaking strength of the holding strip as the cut penetrates into the notch. In either case, the notch can be shaped to cause a gradual change in breaking strength as the cut moves deeper into the notch.

13 Claims, 3 Drawing Sheets

HOLDING STRIP FOR A SEMICONDUCTOR INGOT

TECHNICAL FIELD

This application relates to semiconductor wafer manufacturing.

BACKGROUND

Wafers of semiconductor material can be formed by slicing or cutting pieces from a semiconductor ingot. Cutting devices such as internal diameter (ID) diamond saws or abrasive wires are used to slice the wafers from the ingots.

One wafer fabrication technique involves securing an ingot to a holding strip, usually with an adhesive material, and plunging a saw blade through the ingot and partially through the holding strip. The saw blade retracts without severing the slice from the rest of the holding strip. Leaving the holding strip intact in this manner prevents the newly formed wafer from falling into the saw blade housing or the saw's fluid catch pan. This technique requires manual or mechanical separation of each slice, including both the wafer and the portion of the holding strip to which the wafer is connected, from the rest of the holding strip.

FIG. 1 shows an ingot 100 resting in a conventional holding strip 102. The holding strip 102 is generally rectangular in cross section, with a groove or trench 104 formed in one surface to accommodate the ingot 100 during the wafer cutting process. In general, the holding strip 102 is formed from a material, such as graphite or aluminum oxide, that is much softer than the semiconductor ingot 100 itself. As the cutting edge 106 of the saw blade or other cutting device passes through the ingot 100 and penetrates the holding strip 102, the softer material in the holding strip 102 causes vibration and deflection of the saw blade. This vibration and deflection often causes the blade to chip the edges of the ingot 100 and the newly-formed wafer, damaging the ingot and wafer surfaces and reducing the yield of useful wafers. Reduced yield leads to higher labor and material costs, which in turn lead to higher prices at the consumer level.

Holding strips that are softer or harder than the semiconductor ingots also cause premature dulling of the saw blade and formation of a powder layer on the blade. These conditions reduce the cutting efficiency of the saw blade and lead to more frequent reconditioning or disposal of the saw blade.

Moreover, the rectangular cross section of the holding strip 102 gives the strip a relatively high breaking strength. High breaking strength makes it more difficult to separate the slices from the rest of the holding strip 102 and therefore adds to the cost of the wafer production.

SUMMARY

This application provides techniques for reducing chipping of semiconductor wafers during the cutting process and for reducing the breaking strength of partially cut holding strips. These techniques lead to higher wafer yield and reduced wear-and-tear on wafer cutting devices. As a result, the costs associated with wafer fabrication, and thus the ultimate costs of consumer goods, are lower when these techniques are used during wafer fabrication.

The invention is useful in the production of semiconductor wafers from a semiconductor ingot. In some aspects, the ingot rests against a holding strip that is formed from a semiconductor material, typically the same material used to form the ingot. A wide variety of semiconductor materials, including single-crystalline and polycrystalline materials, can be used to form the holding strip.

In other aspects, the holding strip has a holding surface shaped to receive the ingot and at least one surface other than the holding surface, into which at least one notch is formed. The holding strip has a characteristic breaking strength that changes when a cut is formed through the holding surface and into the notch. In some embodiments, the notch has sides that are substantially parallel to each other, and in other embodiments, the notch has tapered sides. In alternative embodiments, the shape of the notch causes an abrupt change or a gradual change in the breaking strength of the holding strip as the cut penetrates into the notch. In either case, the notch can be shaped to cause a gradual change in breaking strength as the cut moves deeper into the notch.

DETAILED DESCRIPTION

The present inventors recognized that any of the problems associated with using holding strips during wafer fabrication are alleviated or eliminated when the holding strips are made from semiconductor materials. In particular, a holding strip that is formed from the same semiconductor material as the ingot that it holds is no harder or softer than the ingot. The semiconductor holding strip thus causes much less vibration and deflection of the saw blade than is caused by a holding strip made from a harder or softer material, such as graphite or aluminum oxide. Semiconductor holding strips therefore produce higher wafer yield and less blade dulling, thereby reducing the costs associated with wafer fabrication.

For example, in one test carried out in a wafer fabrication facility, wafers were formed by cutting two 4-inch diameter silicon crystal ingots with an ID saw. One of the ingots was 4.90 inches long and was mounted to a conventional aluminum oxide (AlO) holding strip. The other ingot was 4.66 inches long and was mounted to a silicon (AlO) holding strip. Equal-size wafers were cut from each of the ingots. The ingot mounted to the AlO strip yielded 83 usable wafers, and the ingot mounted to the Si strip yielded 106 usable wafers. Taking the ingot lengths into account, the Si-to-AlO yield ratio was 1.34:1. The most common effects in unusable wafers were edge chips caused by blade deflection and vibration.

A potential problem with semiconductor holding strips is that semiconductor materials, such as silicon, have higher breaking strengths than the materials from which conventional holding strips are made. As a result, breaking a wafer slice away from a semiconductor holding strip can be more difficult than breaking a slice away from a conventional holding strip. The holding strips described below have structures that alleviate this potential problem, reducing the breaking strengths associated with semiconductor holding strips.

Figure 1:
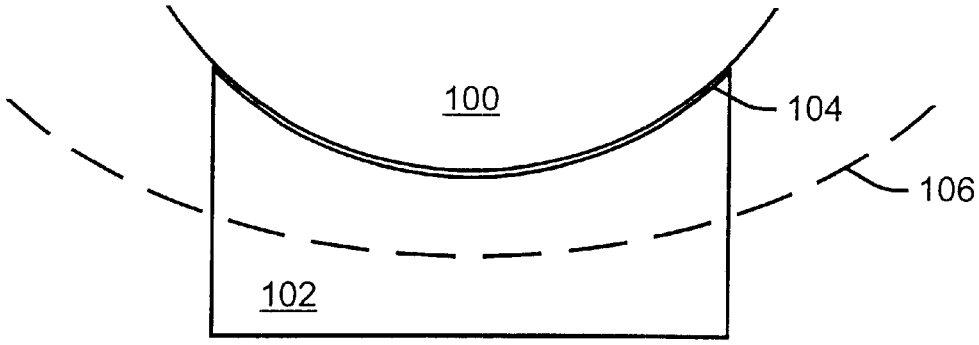
FIG. 1 shows a partial cross section of an ingot resting in a conventional holding strip.
Figure 2:
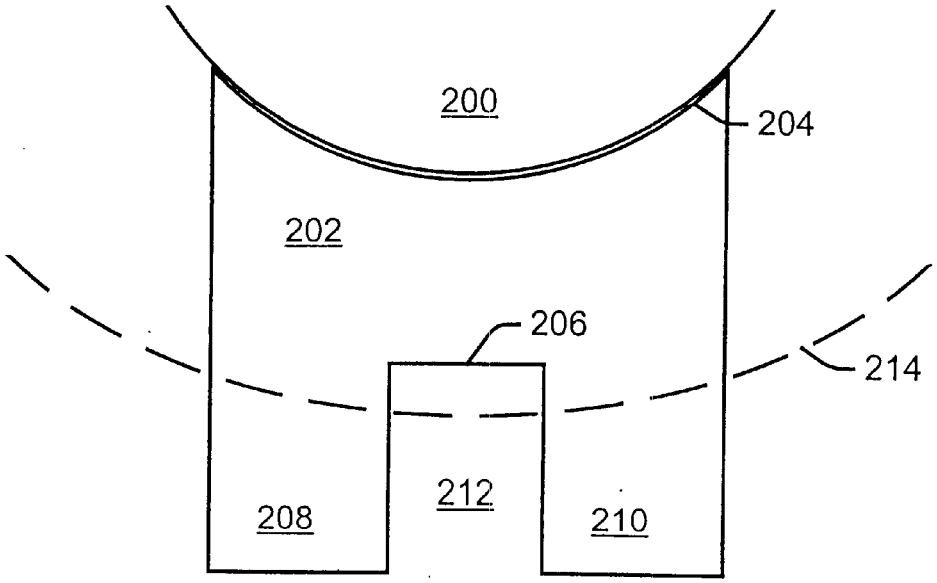
FIGS. 2, 3, and 4 show partial cross sections of ingots resting in semiconductor holding strips with reduced breaking strengths.

FIG. 2 shows a partial cross section of a semiconductor ingot 200 resting on a semiconductor holding strip 202 with a reduced breaking strength. One surface 204 of the holding strip (the "holding surface") contacts the ingot 200 to hold the wafer slices in place during the cutting process. In the embodiment shown here, the shape of the holding surface 204 roughly follows the surface curvature of the ingot 200. Other embodiments include V-shaped or U-shaped holding surfaces, which are useful in holding ingots of various sizes and shapes.

Opposite the holding surface 204 is the lower surface 206 of the holding strip 202. Two legs 208, 210 extend from the lower surface 206, away from the holding surface 204, to form a notch 212 in the holding strip 202. This notch 212 produces an abrupt change in the breaking strength of the holding strip 202 when the cutting edge 214 of the saw blade penetrates the notch 212. In general, the breaking strength of the holding strip 202 along the notch 212 is a fraction of the breaking strength above the notch 212, as determined by the ratio of the combined width of the legs 208, 210 at the cutting edge 214 to the total width of the holding strip 202.

Figure 3:
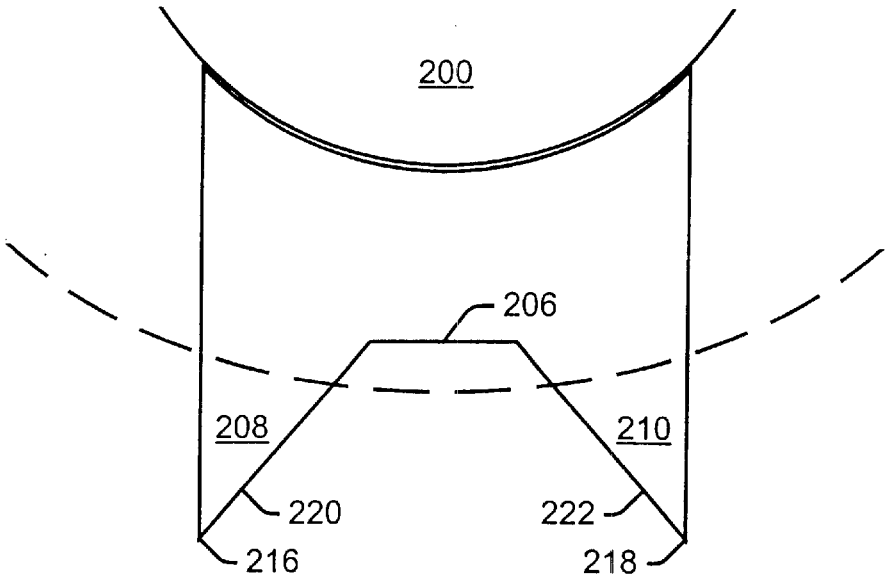

FIG. 3 shows another embodiment of the semiconductor holding strip 202. In this embodiment, the legs 208, 210 that extend from the lower surface 206 of the strip 202 taper away from each other, ending in pointed tips 216, 218. As a result, the notch 212 increases in width from the lower surface 206 to the pointed tips 216, 218 of the legs 208, 210. In the embodiment shown here, the legs 208, 210 taper linearly, having straight surfaces 220, 222 from the lower surface 206 of the strip 202 to the pointed tips 216, 218. In other embodiments, the legs 208, 210 have curved surfaces with increasing or decreasing tapering rates.

As with the embodiment of FIG. 2, the notch 212 in this embodiment produces an abrupt reduction in the breaking strength of the holding strip 202 when the cutting edge 214 of a saw blade penetrates the notch 212. Tapering the legs 208, 210 of the holding strip 202 further reduces breaking strength as the cutting edge 214 penetrates further into the notch 212. Gradual tapering produces gradual changes in breaking strength as the cut deepens.

Figure 4:
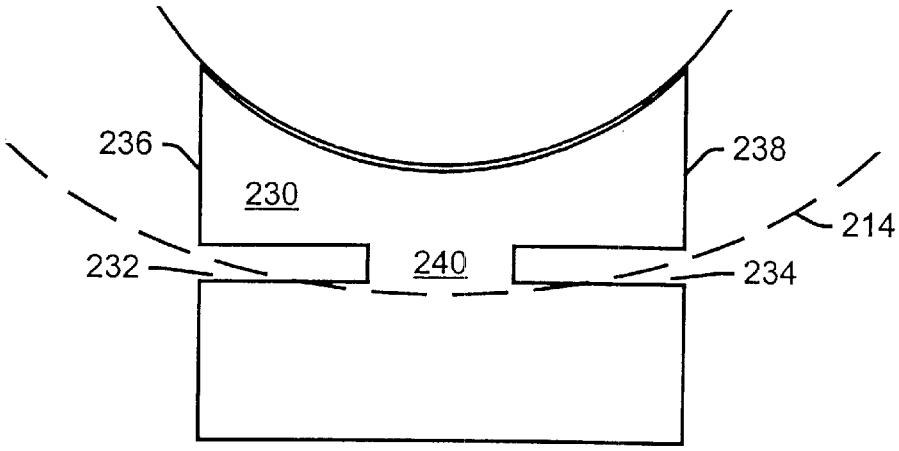

FIG. 4 shows another semiconductor holding strip 230 having two notches 232, 234 formed in opposing side surfaces 236, 238 of the strip 230. The two notches 232, 234 extend from the opposing surfaces 236, 238 toward each other, forming a narrow neck 240 in the holding strip 230. The notches 232, 234 together produce an abrupt change in the breaking strength of the holding strip 230 when the saw blade 214 penetrates the notches 232, 234.

Figure 5:
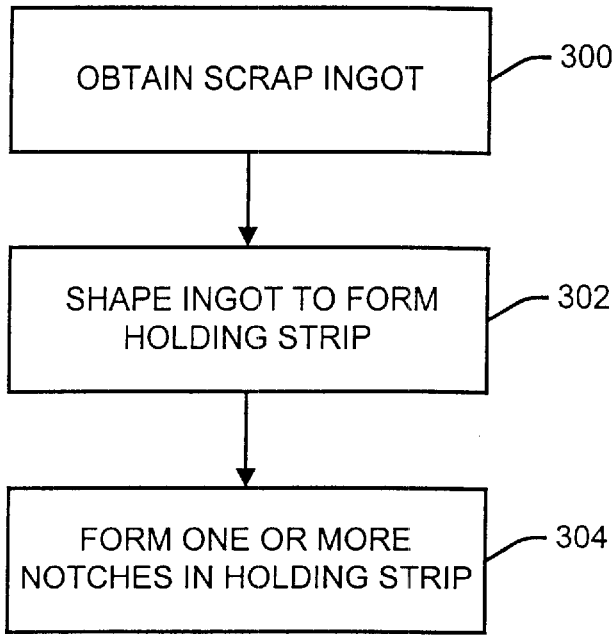
FIGS. 5 and 6 show flowcharts of techniques for producing semiconductor holding strips.

The semiconductor holding strips described here all can be produced using standard wafer fabrication tools and techniques. FIG. 5 illustrates a technique by which a semiconductor holding strip is formed from a scrap semiconductor ingot. This technique involves obtaining a scrap ingot (step 300) and shaping the ingot to form a holding strip (step 302). Standard tools such as wafer saws and grinding wheels are used to form the holding strip. These tools are then used to form one or more notches in the surfaces of the holding strip, cutting or grinding material away until the notch has the desired size (step 304).

Figure 6:
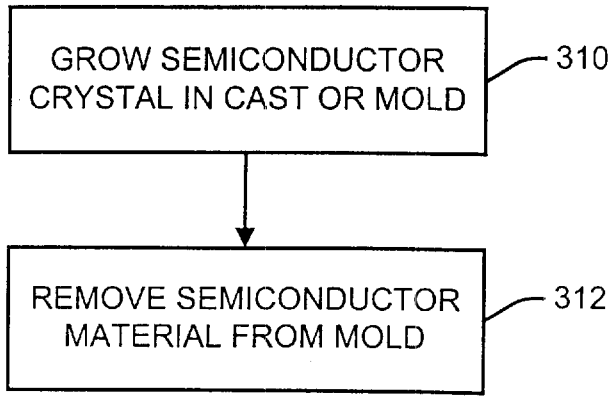

FIG. 6 illustrates another technique for producing a semiconductor holding strip. This technique involves growing a semiconductor material, such as single-crystal or polycrystal silicon, in a negative cast or mold (step 310). The grown semiconductor material is then removed from the cast and used as a holding strip (step 312).

Several embodiments are described here. Nevertheless, a person of ordinary skill in the art will understand that the invention is not limited to these embodiments. For example, some semiconductor holding strips are made from materials other than silicon. Many holding strips also have shapes other than those described here. For example, one type of strip has a notch that tapers to a point at the strip's lower surface (e.g., a triangular notch). The breaking strength of this strip does not change abruptly at the notch, but instead decreases gradually as the saw blade penetrates into the notch. Accordingly, other embodiments are within the scope of the following claims.

What is claimed is:

1. A holding strip for use in holding a semiconductor ingot during a wafer cutting process, the holding strip comprising a solid material that includes:

a holding surface shaped to receive an ingot;

at least one surface other than the holding surface; and at least one notch formed in at least one surface other than the holding surface;

where the holding strip has a characteristic breaking strength that changes when a cut is formed through the holding surface and into the notch.

2. The holding strip of claim 1, wherein the notch has sides that are substantially parallel to each other.

3. The holding strip of claim 1, wherein the notch has tapered sides.

4. The holding strip of claim 1, wherein the notch has a shape that causes an abrupt change in the breaking strength as the cut penetrates into the notch.

5. The holding strip of claim 4, wherein the notch has a shape that causes the breaking strength to change gradually as the cut moves deeper into the notch.

6. The holding strip of claim 1, wherein the notch has a shape that causes the breaking strength to change gradually as the cut penetrates into the notch.

7. The holding strip of claim 1, wherein the solid material comprises a semiconductor material.

8. The holding strip of claim 1, wherein the solid material comprises silicon.

9. The holding strip of claim 1, wherein the solid material comprises a single-crystal semiconductor material.

10. The holding strip of claim 1, wherein the solid material comprises a polycrystal semiconductor material.

11. A method for use in producing semiconductor wafers, the method comprising:

placing a semiconductor ingot on a holding strip that has a breaking strength with more than one possible value; and passing a cutting device through the ingot and into the holding strip to a depth that causes the breaking strength to change from one value to another value.

12. The method of claim 11, wherein passing the cutting device into the holding strip includes moving the cutting device to a depth that causes the breaking strength to change abruptly from one value to another value.

13. The method of claim 11, wherein passing the cutting device into the holding strip includes moving the cutting device to depths that cause the breaking strength to change gradually among values.

* * * * *